US009028204B2

(12) United States Patent
Døssing

(10) Patent No.: US 9,028,204 B2
(45) Date of Patent: May 12, 2015

(54) CENTRIFUGAL PUMP ASSEMBLY

(75) Inventor: Bent Døssing, Silkeborg (DK)

(73) Assignee: Grundfos Management a/s, Bjerringbro (DK)

( * ) Notice: Subject to any disclaimer, the term of this patent is extended or adjusted under 35 U.S.C. 154(b) by 1724 days.

(21) Appl. No.: 11/770,763

(22) Filed: Jun. 29, 2007

(65) Prior Publication Data

US 2008/0008578 A1 Jan. 10, 2008

(30) Foreign Application Priority Data

Jun. 29, 2006 (EP) ..... 06013504

(51) Int. Cl.

| | |
|---|---|
| ***F01D 25/00*** | (2006.01) |
| ***F04D 29/00*** | (2006.01) |
| ***F04D 17/08*** | (2006.01) |
| ***F04D 9/00*** | (2006.01) |

(52) U.S. Cl.
CPC ..... *F04D 9/003* (2013.01)

(58) Field of Classification Search
CPC ..... F04D 29/00; F04D 17/08; F04D 9/003
USPC ..... 96/155–220; 210/150, 151, 180, 188; 95/262; 415/169.1–169.4
See application file for complete search history.

(56) References Cited

U.S. PATENT DOCUMENTS

| | | | | |
|---|---|---|---|---|
| 1,674,115 | A * | 6/1928 | La Bour | 417/54 |
| 1,972,304 | A * | 9/1934 | La Bour | 415/56.4 |
| 2,005,466 | A * | 6/1935 | La Bour | 415/1 |
| 2,019,143 | A * | 10/1935 | La Bour | 415/1 |
| 2,110,883 | A * | 3/1938 | La Bour | 415/56.4 |
| 2,461,925 | A * | 2/1949 | Rupp | 415/56.4 |
| 2,755,743 | A * | 7/1956 | Rupp | 415/56.1 |
| 2,831,434 | A * | 4/1958 | Paashaus | 415/56.1 |
| 3,290,864 | A | 12/1966 | Harker et al. | |
| 3,325,974 | A * | 6/1967 | Griffin, III et al. | 96/162 |
| 3,715,863 | A * | 2/1973 | Zanoni | 96/170 |
| 3,893,781 | A * | 7/1975 | Aga | 415/56.4 |
| 4,447,189 | A * | 5/1984 | Jensen et al. | 415/169.1 |
| 4,844,687 | A * | 7/1989 | Korthaus | 415/56.1 |
| 5,622,621 | A * | 4/1997 | Kramer | 210/188 |
| 5,766,547 | A * | 6/1998 | Kay et al. | 422/5 |
| 5,861,052 | A * | 1/1999 | Meinander | 95/243 |
| 6,129,523 | A * | 10/2000 | Ruhnke | 417/313 |
| 6,376,732 | B1 * | 4/2002 | Ngan et al. | 585/800 |
| 6,629,821 | B1 * | 10/2003 | Yokota et al. | 417/199.1 |
| 6,702,877 | B1 * | 3/2004 | Swanborn | 95/269 |

(Continued)

FOREIGN PATENT DOCUMENTS

| | | | |
|---|---|---|---|
| DE | 1653725 | | 1/1972 |
| DE | 3813654 | A1 | 11/1989 |
| DE | 29718285 | U1 | 1/1998 |
| DE | 19920780 | A1 | 7/2000 |
| EP | 1024292 | A2 | 8/2000 |

*Primary Examiner* — Thomas McKenzie
(74) *Attorney, Agent, or Firm* — Panitch Schwarze Belisario & Nadel LLP

(57) ABSTRACT

The centrifugal pump assembly comprises a device for separating gas from the fluid to be delivered, which is arranged on the suction side. The gas separation device is provided with an impact body (2) which at least partly is arranged in the suction-side flow path (11) of the fluid to be delivered, and on the housing side is arranged at a distance to the suction port of the pump.

2 Claims, 9 Drawing Sheets

(56) References Cited

U.S. PATENT DOCUMENTS

| | | | | |
|---|---|---|---|---|
| 6,752,860 | B1 * | 6/2004 | Hoydal et al. | 96/157 |
| 7,060,122 | B2 * | 6/2006 | Bhatia et al. | 96/204 |
| 7,163,626 | B1 * | 1/2007 | Cuypers et al. | 210/512.3 |
| 7,290,981 | B2 * | 11/2007 | Guzorek | 415/151 |
| 7,461,692 | B1 * | 12/2008 | Wang | 166/105.5 |
| 2002/0146319 | A1 * | 10/2002 | Dorsch et al. | 415/206 |
| 2003/0175110 | A1 * | 9/2003 | Schmidt et al. | 415/55.1 |
| 2006/0272626 | A1 * | 12/2006 | Roberts et al. | 123/573 |

* cited by examiner

CENTRIFUGAL PUMP ASSEMBLY

BACKGROUND OF THE INVENTION

The invention relates to a centrifugal pump assembly with a device for separating gas from the fluid to be delivered.

Centrifugal pump assemblies of the previously mentioned type are typically applied in heating installations as circulation pumps, but also on other fields. Even if such systems are typically designed in a pressure-tight manner, one may often not prevent the circulated fluid from entraining gas, in particular air, which is to be separated away from the system, usefully before running through the centrifugal pump. The provision of gas separation devices in such systems is therefore counted as belonging to the state of the art.

With an increasing integration of systems, one has gone over to integrating such a gas separation device in the centrifugal pump assembly (DE 199 20 780 A1), typically on the suction side between the suction stub and the entry to the pump, the suction port. Thereby, the extension of the pump housing on the suction side and dividing it via a so-called deflector plate which has a central opening, in order to form a separation space, into which the fluid flowing in on the suction side firstly enters and the flow speed slows down, before it is again withdrawn centrally to the suction port of the pump, is counted as belonging to the state of the art. A so-called air vent which comprises a bleed valve, with which the gas separated from the delivery fluid is automatically led away to the environment, connects to this calming space in the installation position on the upper side. In order to prevent a turbulent or other rapid fluid flow in the region of this air vent, which would compromise the separation procedure, thus the separation of the gas and fluid, a guidance device is typically provided on the deflector plate, and this device shields this region of the calming space from the remaining flow.

The disadvantage with this known design, is on the one hand that the gas separation is often not adequate, and on the other hand that the guidance device which is attached on the deflector plate must be aligned in an exact manner on assembly, so that it is located at the predefined location within the housing.

BRIEF SUMMARY OF THE INVENTION

Against this background, it is the object of the invention to design a centrifugal pump assembly of the initially mentioned type, such that on the one hand the gas separation is improved, and on the other hand the manufacture, in particular the assembly of the assembly is simplified.

According to the invention a centrifugal pump assembly with a device for separating gas from the fluid to be delivered achieves this object. Advantageous designs of the invention are specified in the dependent claims, the subsequent description and the drawings.

The centrifugal pump assembly according to the invention comprises a device arranged on the suction side for separating gas out of the fluid to be delivered. This gas separation device comprises an impact body which at least partly is arranged in the suction-side flow path of the fluid to be delivered, and on the housing side at a distance to the suction port of the pump.

The basic concept of the solution according to the invention is on the one hand to provide an impact body in the suction-side flow path of the fluid to be delivered, thus in the region in which the fluid coming from the suction stub flows into the assembly housing, said impact body being arranged such that the fluid flowing in flows onto it completely or partly, and specifically such that the fluid jet formed within the housing is incident onto the impact surface of the impact body and preferably essentially perpendicularly thereto. Surprisingly, it has been found that a particularly effective and good gas separation is achieved due the fact that a part of the housing-internal fluid hits the impact body. Thereby, either a part of the impact body may be impinged by a part of the fluid flowing into the housing, or if the impact body is sufficiently small, this is completely subjected to onflow by a part of the flow. Usefully however, the arrangement is such that it is not the entire flow which impacts the impact body. In particular, the region of the edge of the impact body is particularly effective for the separation procedure, in that the pressure conditions in the edge region cause the separation procedure.

Furthermore, the impact body according to the invention is arranged on the housing side and at a distance to the suction port of the pump. By way of this, on the one hand one succeeds in the inflow region of the pump, thus the suction port not being essentially influenced by the impact body with regard to flow technology, and on the other hand in the separated gas behind the impact body in the calmed region being able to rise in an undisturbed manner to the float housing arranged thereabove, and in the impact body being able to be fastened on the housing side, typically as one piece with the corresponding housing part, if this is formed for example as a plastic injection molded part. This arrangement has the great advantage that the deflector plate which separates the pump housing from the gas separation device and thus from the gas separation housing, may be formed in a rotational symmetrical manner and plate-like, which not only simplifies the manufacture, but in particular also the assembly, since an alignment of the plate in the peripheral direction as is the case with the state of the art, is not necessary.

According to a further formation of the invention, the assembly housing comprises a pump housing with a suction port, said housing accommodating the impeller, and a gas-separation housing connecting to the suction port, which are separated by an intermediate wall. The impact body according to the invention thereby is arranged within the gas separation housing and comprises an impact surface which is directed essentially radially or parallel to a radial line and preferably also parallel to the impeller axis. Such an alignment of the impact surface has been proven to be particularly effective, and permits an effective gas separation with comparatively small housing dimensions.

Advantageously, the impact body is designed as a rib, which on at least at one, preferably however on two or three sides, is connected to the gas separation housing. The fastening thereby is typically effected at the end-wall which lies opposite the intermediate wall (deflector plate) and with which the rib may advantageously be designed as one piece. Depending on the extension of the rib, this may reach from one to the other peripheral wall. Advantageously, the rib extends from peripheral wall to peripheral wall at a distance beyond the suction port of the pump.

In order to be able to manufacture and assemble the assembly housing, in particular the housing parts leading fluid, in an inexpensive manner, it is advantageous to design the gas separation housing on the one hand and the pump housing on the other hand in each case as one piece as a cast part. Usefully, the impact body thereby forms a part of the gas separation housing. If the impact body is designed as a rib, the gas separation housing may be designed without undercuts, or at least be designed such that the application of lost cores may be done away with on injection molding. This may be achieved in a simple form by way of the impact body, in particular in the form of a rib, being designed without undercuts in the drawing direction of the tool.

If the gas separation housing and the pump housing are separated by an intermediate wall, which is advantageous, then it is useful to arrange the impact body at a distance to the intermediate wall, in order thus to let the turbulences arise in the region of the impact body at an adequate distance to the suction port of the pump.

According to one advantageous further formation of the invention, the impact body may be designed in an angled manner and in a manner such that impact surface parts which are at an angle to one another are formed. The angle which these impact surfaces span is between 90° and 270°, particularly preferably it is selected between 135° and 225°. In particular, the design of the rib which is angled once or several times may be advantageous if the de-coring of the gas separation housing consists of lost cores as well as drawing cores. Furthermore, the size of the calming space above the rib may be influenced by way of the angled bending of the rib.

Thereby, it has been found to be particularly favourable if the impact body does not end parallel to the intermediate wall at a distance, but the distance between the impact body and the intermediate wall becomes smaller with an increasing radial distance of the impeller axis, i.e. the impact body becomes larger with an increasing radial distance in its extension in the direction of the impeller axis or parallel thereto.

Usefully, the pump housing and the gas separation housing are designed and arranged such that they are aligned to one another with their essentially circular inner contour, wherein the gas separation housing comprises an inlet for the delivery fluid, which connects on the peripheral side. A functional separation between the pump housing and gas separation housing may be effected by way of inserting a deflector plate, wherein the deflector plate may be designed as a rotationally symmetrical plate which does not need to be aligned in the peripheral direction on assembly.

In a further design of the invention, an essentially cylindrical float housing is provided, which is arranged and designed for the integration of a bleed valve. This float housing peripherally passes through the wall of the gas separation housing, wherein the housing part of the float housing located within the gas separation housing is provided with through-holes, and the housing part located outside the gas separation housing is designed in a closed manner. The cylinder-shaped float housing is thus integrated into the assembly housing, wherein the through-holes are arranged such that the separated gas which naturally rises upwards in the gas separation housing, gets into the region of the through-holes and thus into the float housing. A float-controlled bleed valve is arranged in the known manner in the float housing. Such a component which is also indicated as an air vent, is counted as belonging to the state of the art and is therefore not described in detail.

In order to prevent a flow which as the case may be, may even be turbulent, which forms within the gas separation housing, from getting into the region of the float housing, according to a further formation of the invention, one envisages the rib forming the impact body extending beyond the middle longitudinal axis of the gas separation housing which typically coincides with the transverse axis of the pump impeller, up to near to the float housing or beyond this, so that the rib at the same time forms a flow decrease for the region in which the separated gas passes from the gas separation housing into the float housing.

The rib forming the impact body may advantageously also be arranged at a distance below the middle longitudinal axis of the gas separation housing or of the rotation axis of the pump impeller, and such an arrangement is particularly advantageous when the flow enters into the gas separation housing perpendicularly from below or laterally and tangentially from below.

Advantageously, the suction-side connection of the pump assembly is arranged on the gas separation housing, and specifically such that it runs out below the impact body. The installation position of the pump assembly is always defined by the air separation housing which must connect in the upper part of the gas separation housing and whose cylindrical housing must be arranged with an essentially perpendicular axis.

The impact body according to the present invention typically comprises at least one impact surface directed to the inflow. This however does not necessarily need to be closed, and it is thus also conceivable to design the impact body in a comb-like manner, thus to provide a comb-like rib, so that the length of the edge which produces a particularly high degassing effect given an impact of the flow, is increased multiple fold.

It is particularly advantageous if the onflow-side of the impact body, thus the actual impact surface has an angle $\gamma$ to the flow direction of the fluid flowing into the gas separation housing, which is about between 20° to 90°, preferably 45 to 90°. Thereby, the flow direction must not necessarily be that with which the fluid flows from the suction-side connection into the gas separation housing, but as the case may be one may also provide guidance means or housing parts which are firstly subjected to onflow, by which means the flow is deflected before it reaches the impact body. Then, according to the invention, the angle $\gamma$ is to be formed between the flow direction after the effected deflection, and the impact surface.

Furthermore, the impact body is usefully arranged such that it shields the through-holes to the float housing at least partly with respect to the delivery flow, and thus ensures a calming of the fluid and thus a good degassing in this region.

According to the invention, the impact body lies completely or partly aligned to the flow to the suction-side connection of the housing. Aligned to the flow to the suction-side connection of the housing in the context of the present invention means that the impact body lies in the flow direction of the fluid entering into the housing through the suction stub. If the suction stub enters the housing in a straight line, then the impact body lies in an aligned manner in the true context of the word. If however, the inflow into the gas separation housing is effected in a directed manner on the suction side, for example by way of an arcuate connection stub, then the impact body lies in this direction, thus in the flow direction.

Thereby, the arrangement or size of the impact body within the gas separation housing is selected such that between 30% and 70% of the delivery fluid flowing into the gas separation housing through the suction-side connection impinges the impact body, and the remaining part of the delivery fluid flows past the impact body freely into the housing, and as the case may be, impinges a housing wall. The degree of covering between impinging flow and the impact body may advantageously be designed larger, the further the rib is distanced to the suction-side inlet. It has been surprisingly found that a particularly effective degassing of the fluid flowing into the assembly housing is effected with this arrangement.

In particular with inline pumps with which the suction connection and pressure connection lie inline, but also with centrifugal pump assemblies with which the suction-side connection stub is arranged essentially radially to the gas separation housing, it is advantageous to arrange the suction-side connection stub inclined to the end-side wall of the gas separation housing in a manner such that the delivery fluid entering on the suction side flows onto the end-side wall as well as the impact body. An advantageous guidance of the flow within the housing as well as a particularly good degassing is effected due to the onflow onto the end-side wall. Since the assembly housing due to the gas separation housing mounted in front of the actual pump housing is constructed in a comparatively long manner in the axial direction of the impeller, in comparison to common assembly housings without such a gas separation housing, the suction-side as well as the pressure-side connection stub may be designed in an inclined manner, even with the inline construction type.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
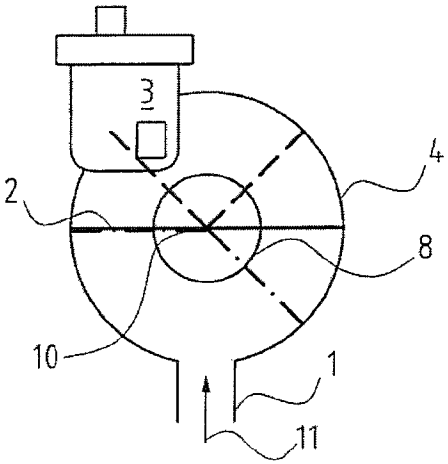
FIGS. 1 to 21 schematic representations of the separation housing with different arrangements of impact body, suction-side connection and float housing, FIGS. 22 to 30 schematic representations from above, with a different arrangement of impact body, suction-side connection and float housing, FIG. 31 in a perspective exploded representation, a pump housing with a gas separation housing attached thereto, with an intermediate wall and pump impeller, FIG. 32 an end view of the housing according to FIG. 31 in the direction of the impeller axis towards the bleed housing, and FIG. 33 a section along the section line D-D in FIG. 32.

Possible arrangements of a suction-side connection 1, impact body in the form of a rib 2, as well as float housing 3 with respect to the gas separation housing 4 are represented by way of FIGS. 1 to 21. The represented arrangements are not conclusive, but are to be understood only as examples.

The basic construction of the pump assembly being discussed here is given by a motor housing which is not shown in the drawings, with an electric motor, a pump housing 5 connecting thereto, as well as a gas separation housing 4 connecting thereto. The shaft of the electric motor in the known manner drives a pump impeller 6 which is rotatably mounted within the pump housing 5. The pump housing 5 and the gas separation housing 4 are separated on the suction side by a separating wall 7 which is incorporated between the mentioned housing parts and which has a central through-hole 8 forming the suction port of the pump. The separating wall 7 is designed as a rotationally symmetrical annular disk. The pressure-side connection 9 is provided on the pump housing 5, whereas the suction-side connection 1 connects on the gas separation housing 4. With the embodiment represented in FIGS. 32 to 34, the connections 1 and 9 lie inline, as is usual with heating circulation pumps. This arrangement of the connections however is only an example, and variations of the arrangement of the suction-side connection 1 are represented by way of FIGS. 1 to 21 as well as 22 to 30.

Figure 2:
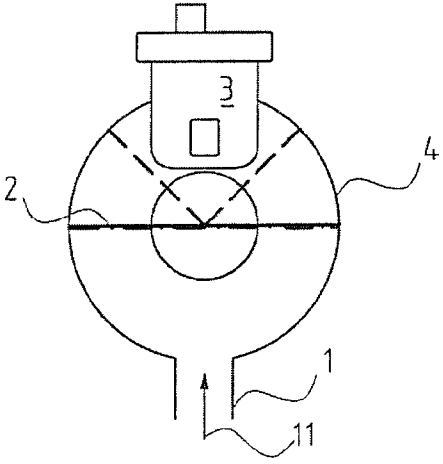
Figure 3:
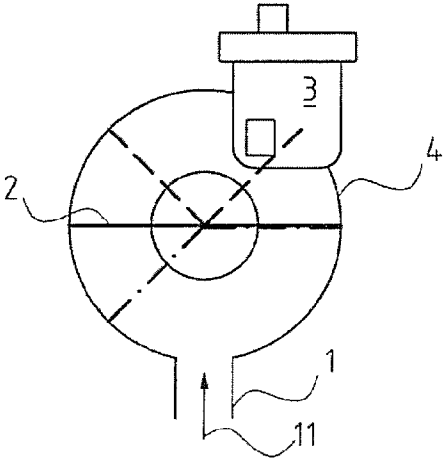

With the embodiments according to FIGS. 1 to 3 and 16 to 18, the suction-side connection 1 is arranged and formed on the lower side of the gas separation housing 4 such that the flow entering therethrough is directed in a radial manner. The embodiment examples according to FIGS. 1 to 3 show ribs 2 which extend through the longitudinal axis 10 of the housing and are fastened at three sides, specifically on the end-side and the two peripheral sides of the gas separation housing 4.

The rib arrangements shown in the schematic representations are to be understood as follows:

the arrangement and design of the rib represented by the unbroken line is particularly advantageous taking into account the arrangement of the suction-side connection 1 and the direction 11 of the inflowing flow resulting therefrom, as well as the arrangement of the float housing 3.

the interrupted lines on the one hand, and the dot-dashed lines on the other hand, represent the limits in which the course of the rib may be selected under the above-mentioned circumstances, in order to achieve an advantageous effect of the gas separation.

Thereby, three different arrangements of the float housing 3 are always shown in a consecutive manner, specifically on the left at the top in FIG. 1, seen in the direction from the gas separation housing 4 to the pump housing 5, in FIG. 2 at the top and in FIG. 3 on the right at the top, in each case passing through the peripheral wall of the gas separation housing 4, with an opening 12 in the form of several through-holes.

With regard to the embodiment represented by way of FIG. 1, with which the float housing 3 connects to the gas separation housing 4 on the top left, the opening 12 of the float housing 3, as otherwise with all embodiments, lies shielded by the rib 2 with respect to the flow direction 11. The rib (unbroken line) which is particularly advantageous for the arrangement according to FIG. 1, extends transversely through the gas separation housing 4 from peripheral wall to peripheral wall along the end-wall, and through the longitudinal axis 10 of the housing. The dot-dashed line in FIG. 1 illustrates that with a given inflow direction from below, the rib part located at the right of the longitudinal axis 10 in FIG. 1, instead of straight course, may also run up to 45° obliquely downwards. The dashed line in FIG. 1 illustrates that also both parts of the rib 2 may run obliquely upwards up to about 45° to the preferred rib arrangement (unbroken line) right and left of the longitudinal axis 10, in order yet to achieve the advantageous gas separation effect. With the embodiment example according to FIG. 1, the rib part located on the left side of the longitudinal axis 10 may thus be arranged in the region between the horizontal and an imaged line running upwards about 45° obliquely thereto, whereas the rib part arranged on the right of the longitudinal axis 10 may be angled upwards up to 45° or also up to 45° downwards, if the flow enters into the housing radially from below, and the float housing 3 connects to the gas separation housing 4 at the top left.

As FIG. 3 illustrates, a mirror-imaged arrangement possibility results with the arrangement of the float housing 3 at the top right, whereas with the central arrangement at the top, as is shown in FIG. 2, the two rib parts on the right and left of the longitudinal axis 10 should only run horizontally or obliquely upwards up to 45° thereto.

Here, one foregoes the detailed description of the rib arrangements, and here one expressly refers to the FIGS. 1 to 21 as well as 22 to 30, which respectively in unbroken lines illustrate the preferred rib design and arrangement, and in dashed or dot-dashed lines the limits of the possible arrangement of the rib, in each case with three different arrangements of the float housing.

Figure 4:
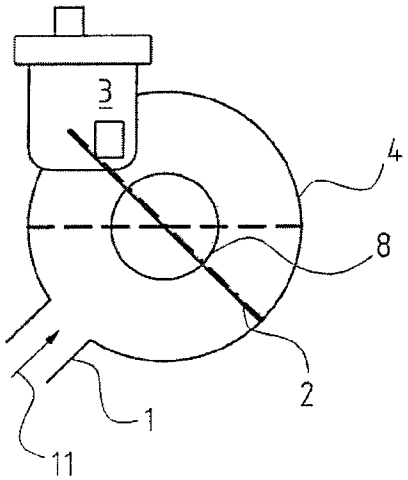
Figure 5:
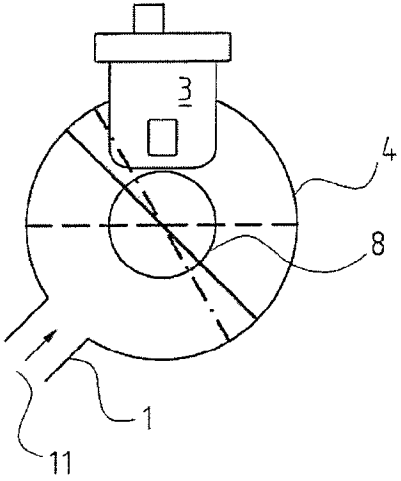
Figure 6:
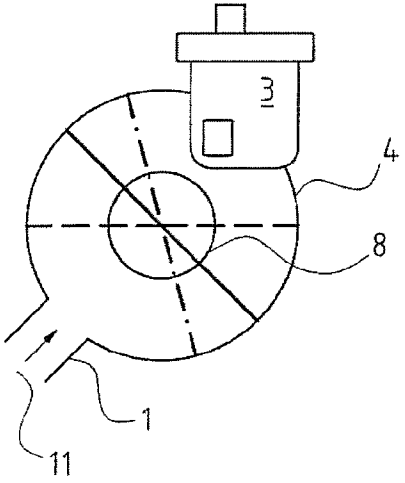
Figure 9:
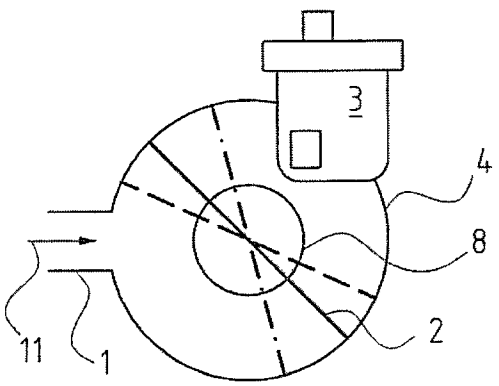
Figure 8:
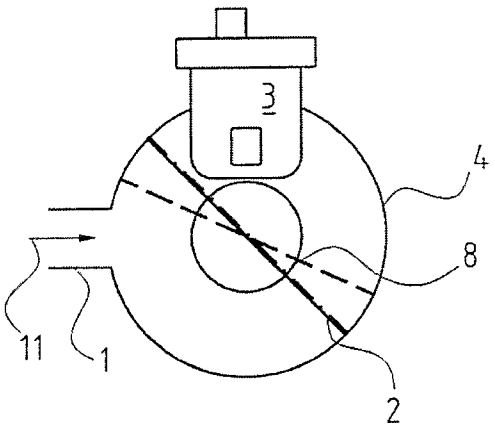
Figure 7:
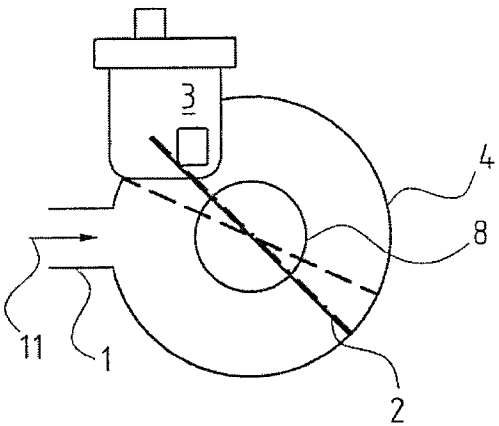
Figure 10:
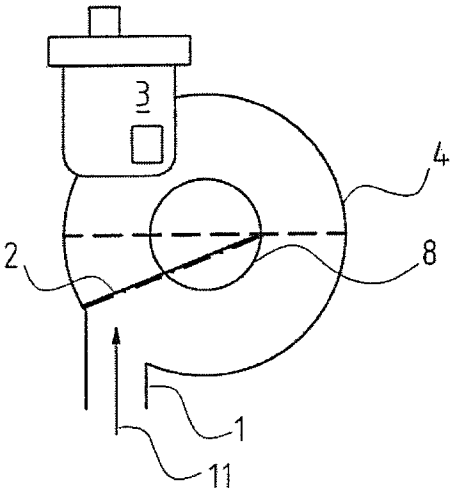
Figure 11:
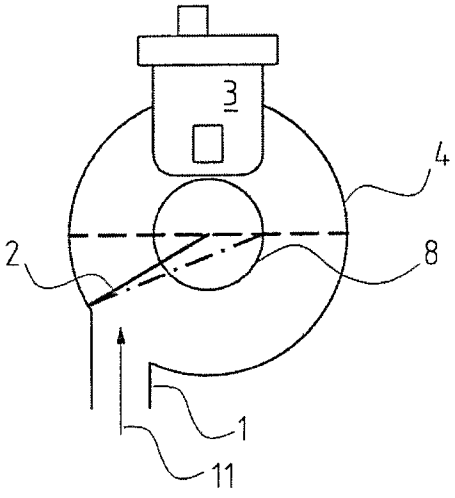
Figure 12:
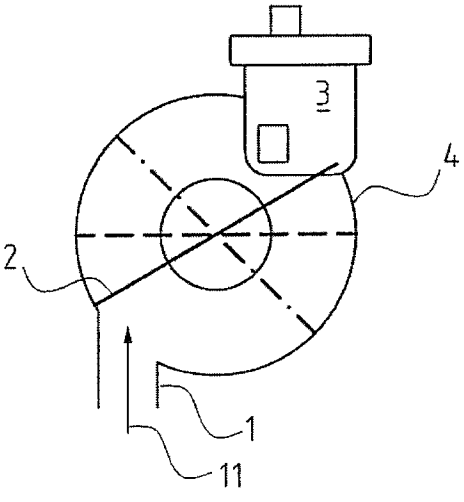

With the embodiments according to FIGS. 4 to 6, the suction-side connections 1 in the figures are attached coming obliquely from the left and below, so that an essentially radial flow, thus directed to the longitudinal axis 10, is effected into the housing. With the arrangements according to the FIGS. 7 to 9, the flow is likewise effected radially, but from the left side roughly at a nine o'clock position. With the embodiment according to FIGS. 10 to 12, the suction-side connection 1 although being provided at the same location as that provided in FIGS. 4 to 6, the alignment however is vertical, so that the flow into the housing is not directed towards the longitudinal axis 10, but rather tangentially and upwards. As the embodiments represented there illustrate, with this arrangement, the rib 2 does not necessarily have to be continuous from the one to the other peripheral side of the gas separation housing, and it thus ends in FIG. 10 roughly at the point at which it has crossed the suction port of the pump. It may however also be continuous to the other peripheral side, as FIG. 10 illustrates with the interrupted line.

Figure 13:
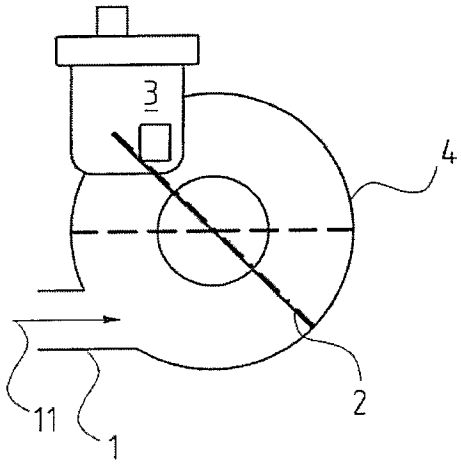
Figure 14:
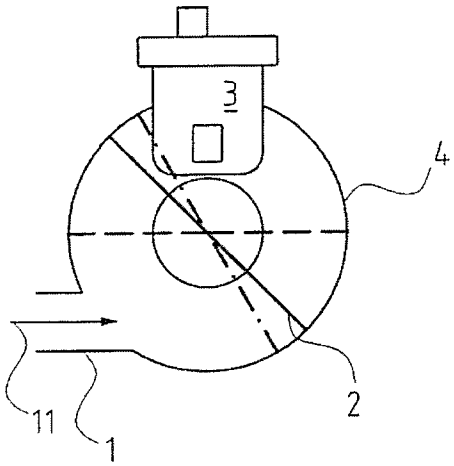
Figure 15:
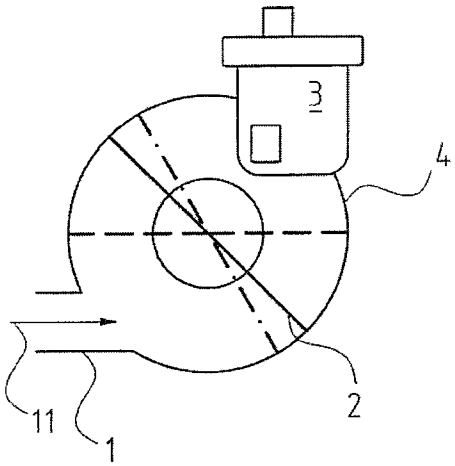
Figure 16:
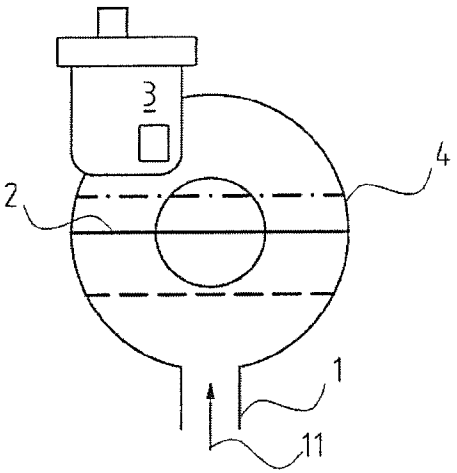
Figure 17:
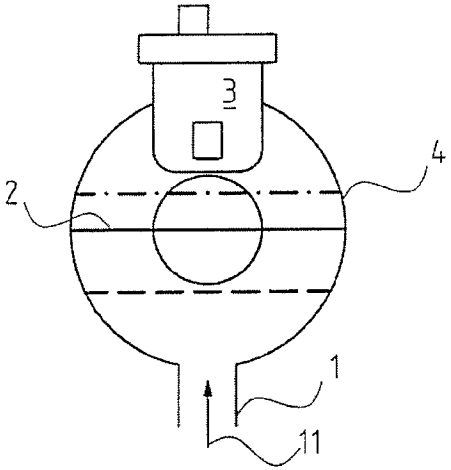
Figure 18:
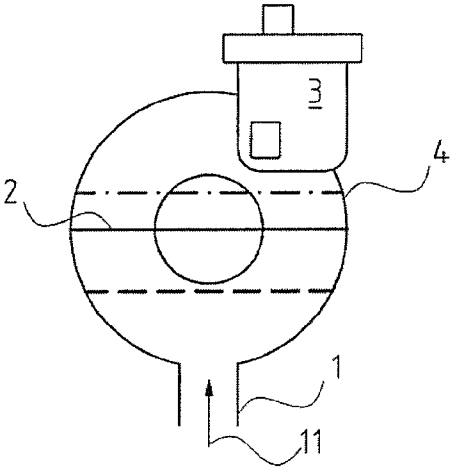
Figure 19:
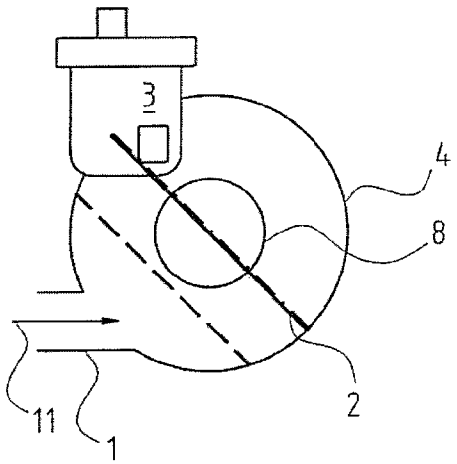
Figure 20:
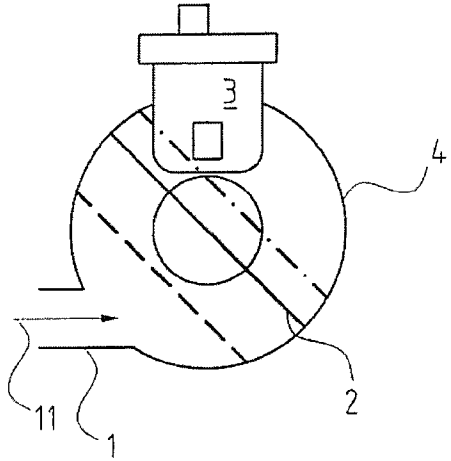
Figure 21:
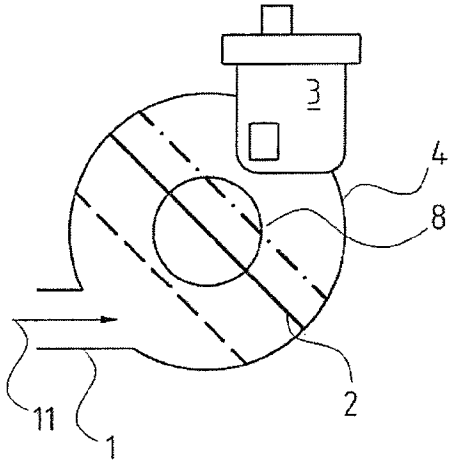
Figure 22:
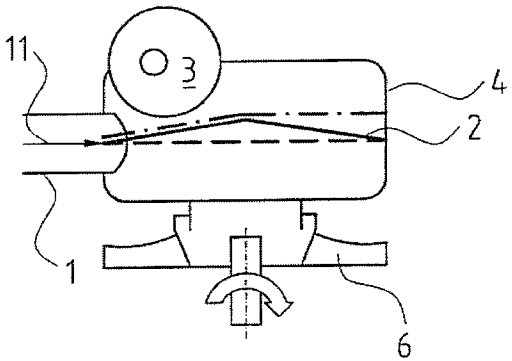
Figure 23:
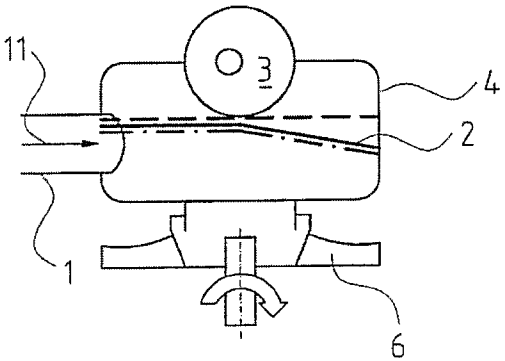
Figure 24:
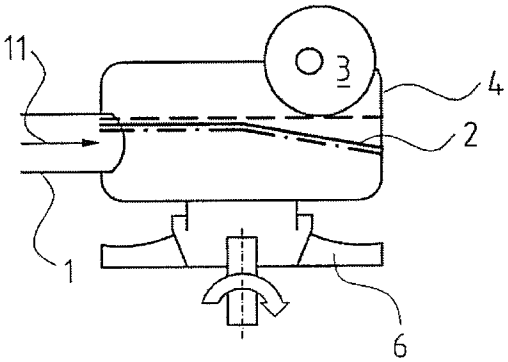

With the embodiment according to FIGS. 13 to 15, the suction-side connection is at the same location as with the embodiment according to the FIGS. 4 to 6 or 10 to 12, but there the inflow is effected essentially tangentially, and specifically in a horizontal manner. With this arrangement, it is advantageous for the rib to be designed in a continuous manner from one to another peripheral side. A corresponding onflow is effected with the embodiments according to FIGS. 19 to 21. There it is shown that the rib does not necessarily need to run through the longitudinal axis 10, but may also be displaced parallel thereto, as this is also represented by way of FIGS. 16 to 18 in comparison to FIGS. 1 to 3.

Common to all embodiments as are represented by way of FIGS. 1 to 21 is the fact that the rib ends at a distance to the separating wall 7. FIGS. 22 to 30 illustrate as to how the course of the rib towards the separating wall is usefully to be designed, wherein there too it is always three variants of the float housing arrangement which are represented, corresponding to the three arrangements of FIGS. 1 to 3, 4 to 6, 7 to 9, etc. In each case, the inflow direction 11 is also shown with FIGS. 23 to 30, and this inflow direction with regard to FIGS. 22 to 24 corresponds to the inflow direction represented by way of FIGS. 7 to 9. With the embodiments according to FIGS. 25 to 27, the suction-side connection 1 lies at the lower side of the gas separation housing corresponding to the representations of FIGS. 1 to 3 or 16 to 18. With the embodiments according to FIGS. 28 to 30, the suction-side connection connects to the gas separation housing in an oblique manner, as this is typically represented by way of FIGS. 4 to 6.

As FIGS. 22 to 30 illustrate, the rib always covers only a part of the flow flowing through the suction-side connection into the gas separation housing 4, about 30 to 50% of the entering jet cross section with regard to area. As FIGS. 22 to 30 illustrate further here, the rib extends at least into alignment of the cylindrical vent housing or beyond it, and thus shields the opening of the bleed housing from the direct flow flowing in through the suction-side connection.

Figure 25:
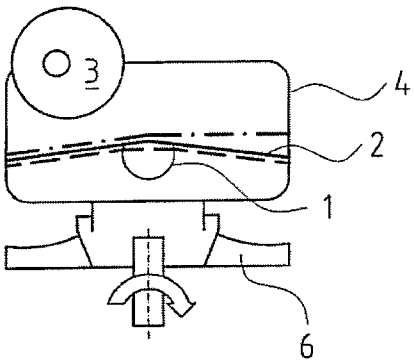
Figure 26:
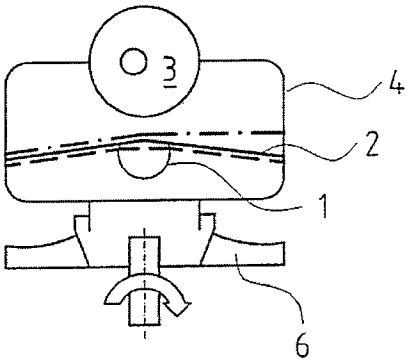
Figure 27:
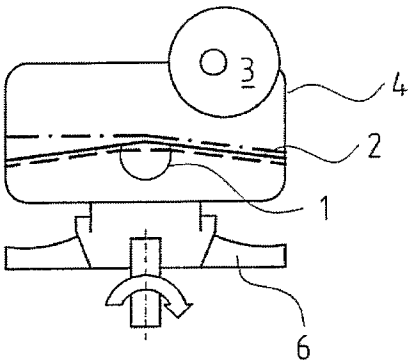
Figure 30:
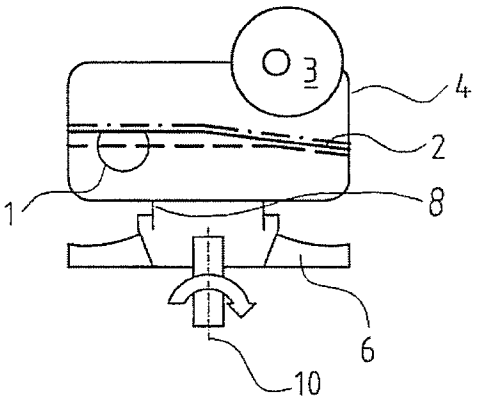
Figure 29:
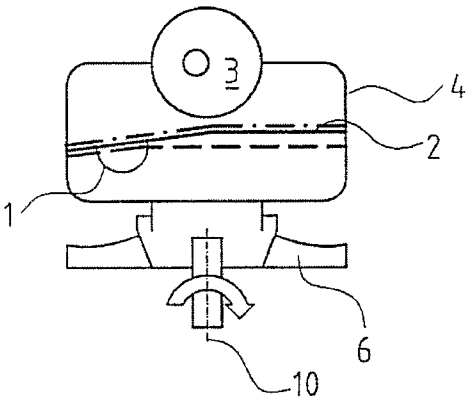
Figure 28:
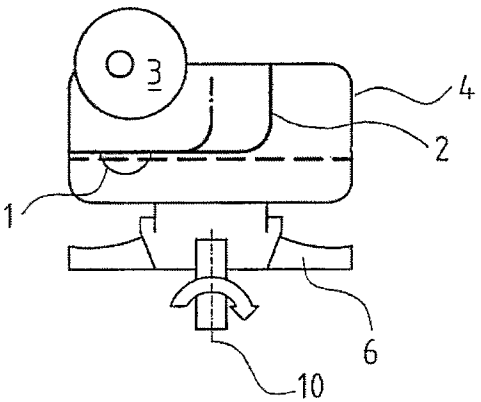
Figure 31:
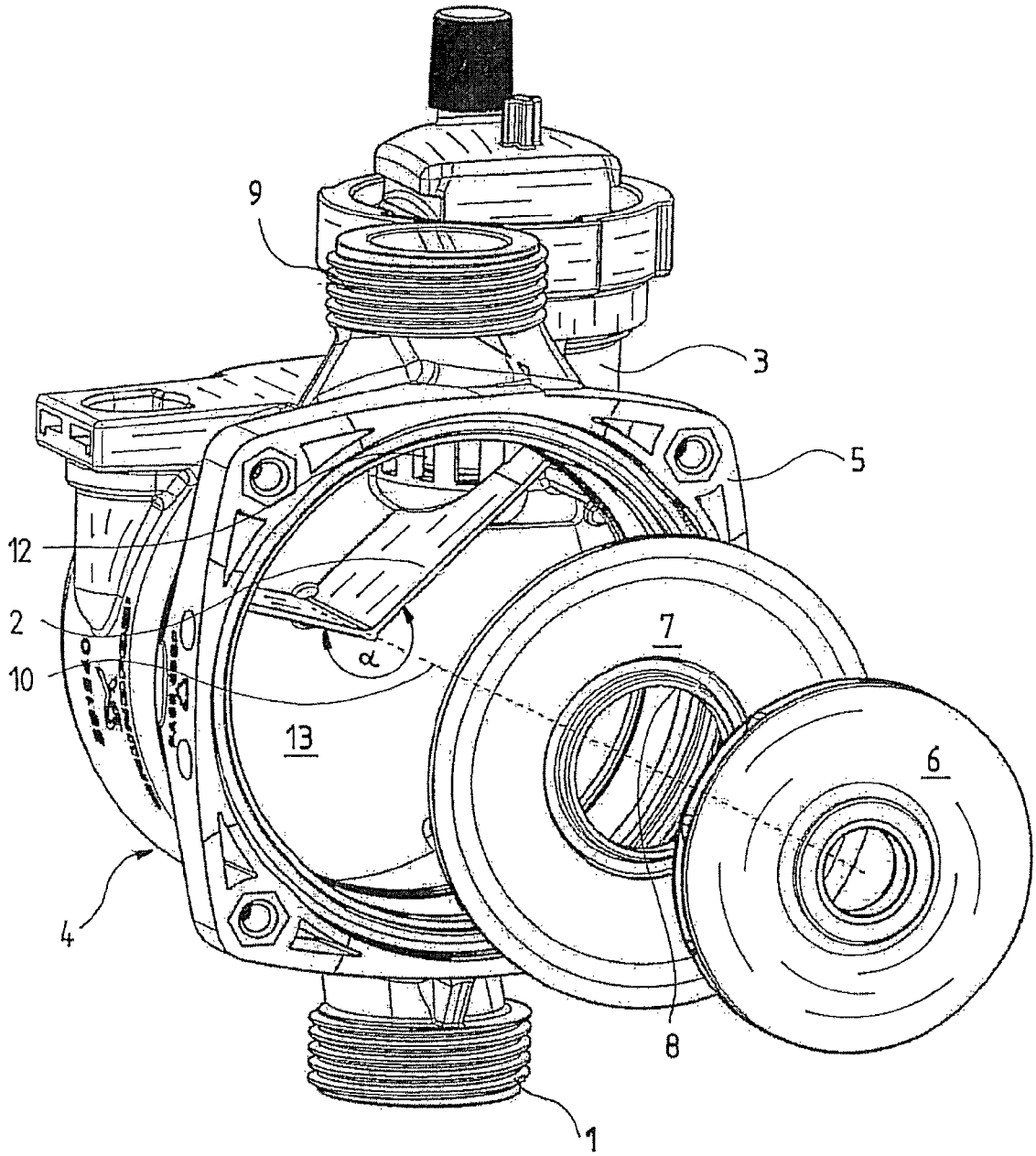
Figure 32:
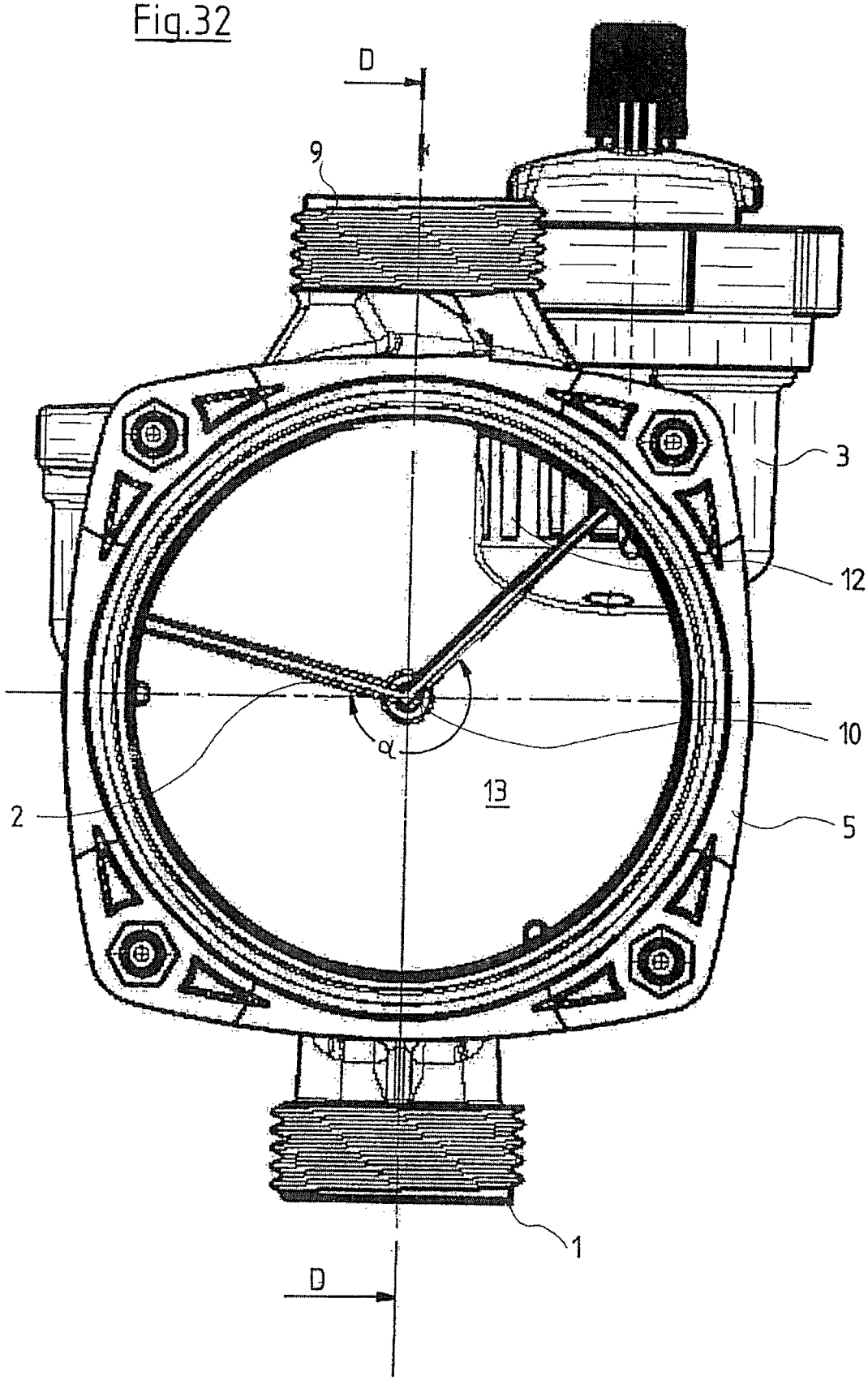
Figure 33:
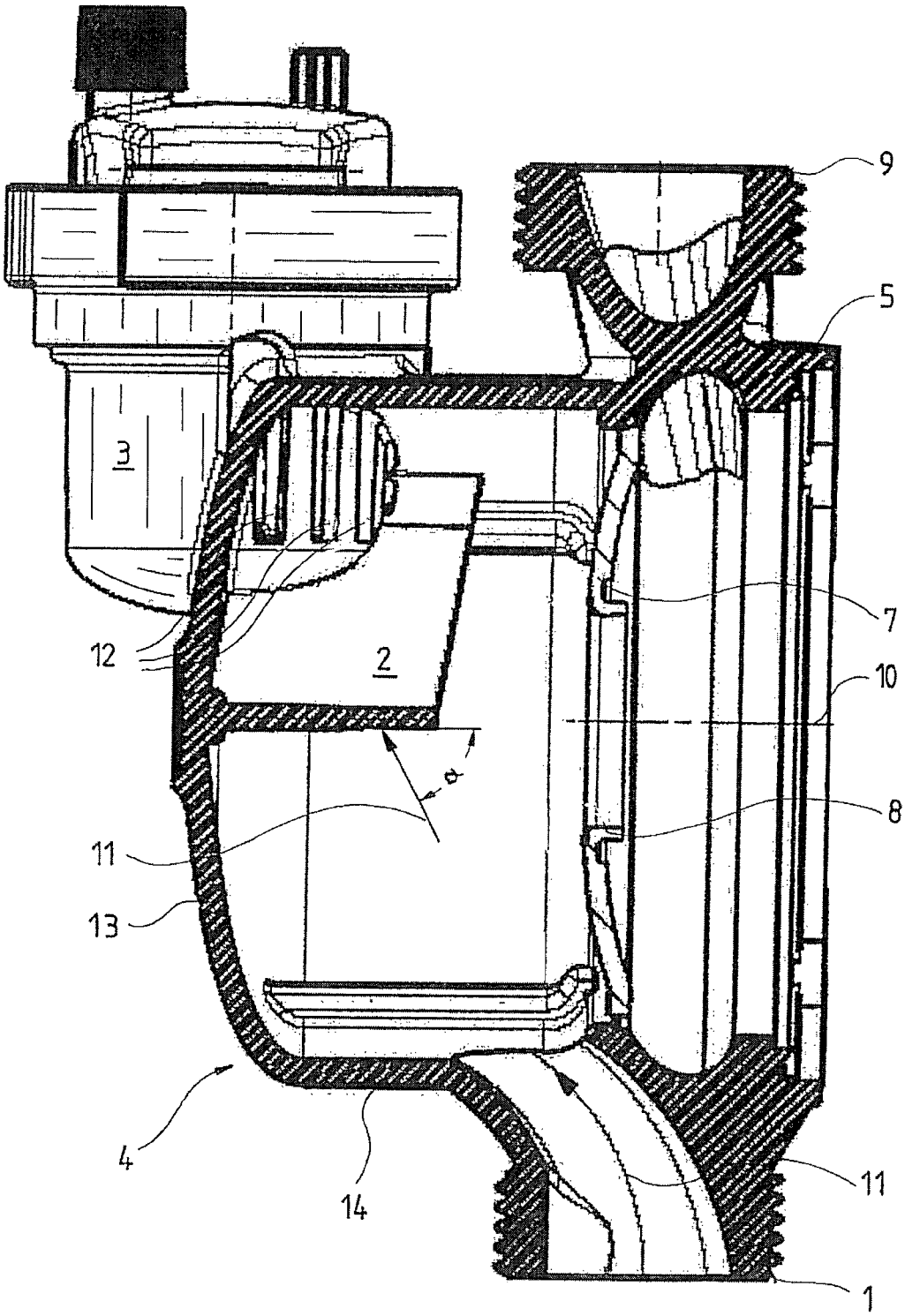

The embodiment represented schematically by way of FIGS. 1 and 25 is shown in detail by way of the FIGS. 31 to 33. It is the case of an inline housing, wherein the suction-side connection 1 runs out at the lower side of the gas separation housing 4, and specifically, as shown in FIG. 33, in a manner such that a flow direction 11 results which is not perpendicular to the longitudinal axis 10, but directed slightly obliquely to the end-side 13 of the gas separation housing 4. The gas separation housing 4 has an essentially cylindrical inner contour and apart from the end-wall 13 which terminates the assembly housing to the front, comprises a wall 14 on the peripheral side, which connects at the end-side to the pump housing 5 aligned thereto. The separating wall 7 is incorporated between the gas separation housing 4 and the pump housing 5, in the form of a deflector plate which functionally separates the two housing parts 4, 5 from one another. The central opening 8 in the separating wall 7 forms the suction port of the pump. The pump impeller 6 represented in FIG. 31 runs within the pump housing 5 in the manner known per se and is driven by the electric motor which is not shown, which is connected on the other side of the pump housing 5 (on the right side in FIG. 33).

The pump housing at its upper side comprises the pressure-side connection 9 which lies inline to the suction-side connection 1 which runs out in the gas separation housing 4.

Within the gas separation housing, the rib 2 is provided as an impact body for the flow entering the housing 4. The rib 2 extends from the wall 15 on the peripheral side, up to the longitudinal axis 10 of the housing, and from there up to the oppositely lying peripheral-side wall 14. It is formed as one piece with the gas separation housing 4 and as FIG. 33 illustrates, it also connects to the end-wall 13, but ends at a distance to the separating wall 7. As is evident by way of FIG. 33, the rib 2 extends in the axial direction 10 or parallel thereto, to a different extent as this is also evident by way of FIG. 25, and it has is smallest extension in the region of the axis 10, thus where the flow arriving from the suction-side connection 1 partly impinges the lower side of the rib 2 and extends a bit further where it impinges onto the peripheral-side wall 14.

The float housing 3 passes through the gas separation housing 4 above the rib 2, and is likewise designed in an essentially cylindrical manner, whose longitudinal axis however runs parallel to a radial line perpendicularly intersecting the axis 10. The float housing 3 contains a float-controlled de-gassing valve which is not shown in detail here and functions such that a float lowers given a gas accumulation within the float housing, and a valve located on the upper side opens by way of this, until the gas collected therein is led away to the outside, and the float is lifted by way of fluid flowing afterwards, and the valve is closed.

The float housing 3 comprises an opening 12 to the gas separation housing 4 which is formed by several through-holes which lie in the region in which the float housing 3 lies within the gas separation housing 4. As FIG. 33 particularly illustrates, the through-holes 12 are shielded in the flow direction 11 by the rib 2, so that the fluid flowing into the gas separation housing 4 may not get directly into the float housing 3.

With the embodiment represented by way of FIGS. 31 to 33, the float housing 3, the gas separation housing 4 and the pump housing 5 are designed as one piece as an injection moulded part, and the separating wall 7 is inserted into the pump housing from the motor side of this, as may be recognised from the exploded representation according to FIG. 31. However, the two housing parts may also be designed separately, and be designed amid the integration of the separating wall 7.

The previously described centrifugal pump assembly, on drive of the pump impeller 6 produces a differential pressure between the suction-side connection 1 and the pressure-side connection 9, by which means fluid flows in the flow direction 11 through the suction-side connection 1 into the gas separation housing 4. Thereby, the inflow is such that about 40% of the inflowing fluid impacts the impact surface formed by the lower side of the rib 2, and the remaining fluid flows past the rib 2. The angle $\gamma$ between the flow direction 11 and the impact surface here is 75°. The rib 2 represented by way of FIGS. 31 to 33 is designed in an angled manner, and specifically about the axis 10 in a manner such that two impact surface sides are formed, which face the suction-side connection 1 and span an angle α which here is 243°. A degassing of the delivery fluid is effected within the gas separation housing 4 by way of the design and arrangement of the previously described rib 2, wherein the gas rises within the housing 4 and penetrates through the through-holes 12 in the wall of the bleed housing 3 into this, and from there is led to the open through the float-controlled degassing valve. Since the rib 2 lies between the suction-side connection 1 and the through-holes 12, it is ensured that the delivery fluid may not get directly into the region of the through-holes 12, but there a calming of the flow is always effected, so that the gas already separated from the fluid collects in this region and may be separated away. Furthermore, the fluid which has flowed into the gas separation housing 4 goes through the central opening 8 in the separating wall 7, which forms the suction port of the pump, into the pump housing 5 and there into the suction port of the impeller 6, which steers the flow further via the pump housing 5 to the pressure-side stub 9.

With the embodiment represented by way of FIGS. 31 to 33, the float housing 3, the gas separation housing 4 and the pump housing 5 are designed as one piece as an injection molded part, and the separating wall 7 is inserted into the pump housing from the motor side of this, as may be recognized from the exploded representation according to FIG. 31. However, the two housing parts may also be designed separately, and be designed amid the integration of the separating wall 7.

I claim:

1. A centrifugal pump assembly with a device for separating gas from a fluid to be delivered, which is arranged on a suction side, wherein the gas separation device comprises an impact body arranged entirely in a suction-side flow path of the fluid to be delivered, and which is arranged on a housing side of the gas separation device at a distance from a suction port of the pump, wherein an assembly housing comprises a pump housing accommodating an impeller, with the suction port, and a gas separation housing connecting to the suction port, which are separated by an intermediate wall, and the impact body is arranged within the gas separation housing and comprises an impact surface which extends radially or parallel to a radial line and parallel to an impeller axis, wherein the impact body comprises a rib connected to the gas separation housing on at least at one side, and wherein a float housing is provided for incorporating a degassing valve, and which peripherally passes through a wall of the gas separation housing, wherein a housing part located within the gas separation housing is provided with through-holes, and a housing part located outside the gas separation housing is designed in a closed manner.

2. A centrifugal pump assembly according to claim 1, wherein the rib forming the impact body extends beyond a middle longitudinal axis of the gas separation housing at least proximate to the float housing.

* * * * *